United States Patent [19]

Racek

[11] 4,419,073

[45] Dec. 6, 1983

[54] GAS LIGHTER

[76] Inventor: Alfred Racek, Seitenberggasse 54, 1160 Wien, Austria

[21] Appl. No.: 269,723

[22] Filed: Jun. 2, 1981

[51] Int. Cl.[3] ..... F23Q 2/16

[52] U.S. Cl. ..... 431/344; 431/276; 431/143

[58] Field of Search ..... 431/130, 131, 143, 150, 431/254, 276, 277, 344

[56] References Cited

U.S. PATENT DOCUMENTS 2,827,782 3/1958 Gruber ..... 431/150
3,484,825 12/1969 Hocq ..... 431/131

FOREIGN PATENT DOCUMENTS 926700 4/1955 Fed. Rep. of Germany ..... 431/130

*Primary Examiner*—Carroll B. Dority, Jr.

*Attorney, Agent, or Firm*—Karl F. Ross; Herbert Dubno

[57] ABSTRACT

A gas lighter emits a flame angled away from an ignition device thereof, the lighter having a gas tank provided with a burner tube centered on an upright axis and formed at the upper end thereof with a flat collar lying transverse to the axis and a flat annular seal provided on an upper surface of the collar. A stamped burner cap is provided at the upper end of the burner tube enclosing the seal, the cap having an upwardly converging conical portion centered on the axis and surrounded by a flat base portion lying parallel to the collar and bearing on an upper surface of the seal, the base portion having a downwardly extending skirt lying parallel to the axis and surrounding the collar, the skirt being formed with inwardly bent shoulders engaging beneath a lower surface of the collar, the conical portion of the cap being formed with a gas orifice at an angle to the axis.

1 Claim, 1 Drawing Figure

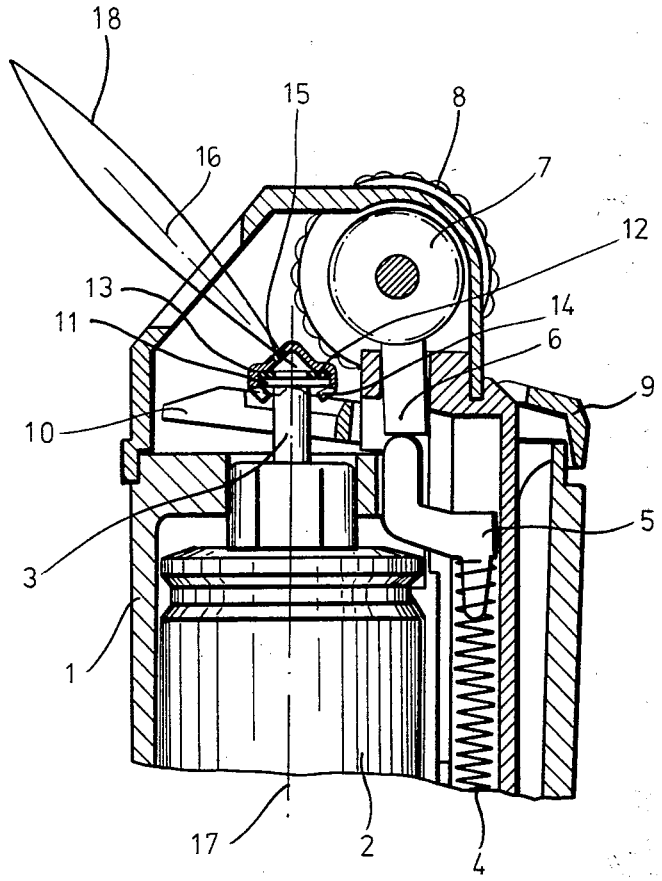
18
15
8
16
7
12
13
14
11
6
9
10
5
3
1
17
2
4

GAS LIGHTER

FIELD OF THE INVENTION

The invention relates to a gas lighter having a housing and a burner tube with an exit nozzle disposed inside the housing, where on the flame end of the burner tube a cap with an exit nozzle is attached and the axis of the exit nozzle is disposed at an angle to the axis of the burner tube.

BACKGROUND OF THE INVENTION

In most gas lighters the axis of the flame exit opening is disposed parallel to the longitudinal axis of the lighter. This results in the disadvantage that when the material to be inflamed is disposed below the lighter, such as for example in the lighting of a pipe or in the igniting of the flame of a cooking location or the like, the lighter has to be kept in a position opposite to the position usual with the lighting of cigaretes. However, this position is cumbersome and in cases burns can result from time to time.

In order to solve this problem it has already been proposed to dispose the axis of the flame exit opening at an angle relative to the axis of the lighter housing. This allows both the igniting of items disposed below the lighter, such as for example the lighting of a pipe, and it also avoids, in particular with short lighters the fingers of the operating person reaching into the hot region of the flame.

In this context it is already known to thread or to fit to the flame end of the burner tube a cap provided with the exit nozzle, where the axis of the exit nozzle runs at an angle with respect to the axis of the burner tube. It has been found that such a provision results in a very uncertain ignition since by way of the thread or with simple fitting, gas escapes through the slot formed between the cap and burner tube and thus a directed burning flame only at the exit opening does not result. The escaping gas prevents either igintion or it also starts to burn. This way a kind of circular flame is produced, which furthermore can burn only for a limited time. The purpose of the device to achieve a flame which is clearly directed to the side is thus not achieved.

OBJECT OF THE INVENTION

It is an object of the present invention to avoid the indicated disadvantages and this is achieved by providing a burner cap having a shoulder which can be edged over a collar of the burner tube and a seal disposed between the cap and the collar. Based on this provision a perfect sealing is achieved and the gas is forced to escape only through the inclined exit nozzle. Apart from this substantial advantage the cap according to the invention is substantially better suited for mass production as compared with the conventional cap. The cap according to the invention can in fact be produced by stamping, where the attachement to the burner tube can be performed automatically.

BRIEF DESCRIPTION OF THE DRAWING

In the following, the invention is described in more detail based on en embodiment shown in the drawing, however without being limited to this embodiment. The sole FIGURE of the drawing shows a sectional view of the upper part of a lighter according to the present invention.

SPECIFIC DESCRIPTION

In accordance with the drawing, a gas tank 2 is disposed in a housing 1, which is provided at its upper end with a burner tube 3. A flint spring 4 is disposed on the side of the gas tank 2 in the housing 1 and the spring 4 presses via a pushrod 5, the flint 6 against a friction wheel 7. This friction wheel 7 is flanked by, and connected with, actuating wheels 8, and the thumb of the user rotates the friction wheel via the actuating wheels 8 and thus a spark can be broken off from the firestone 6. After the rotation of the friction wheel 7 the thumb of the user passes to rest on an actuating member 9, which is formed as a two arm lever and which engages with its fork shaped end 10 a collar 11 of the burner tube 3.

A cap 13 is placed at the end of the burner tube 3 with the interpositioning of a seal 12. The attachment of the cap 13 to the burner tube is performed via shoulders 14, which are edged over the collar 11 of the cap 13 and bent inwardly beneath the lower surface of collar 11. An exit nozzle 15 is formed in the cap 13 with the axis 16 of the exit nozzle 15 at an angle to the axis 17 of the housing 1 or respectively of the gas tank 2.

As can be seen from the drawing in accordance with the invention, the flame 18 is directed such that the operating person will not be burned. Nevertheless, the flame 18 can easily be brought close to an object disposed below the lighter.

It can be clearly seen from the drawing that the pushrod 5 has an S-shape extending toward the burner tube 3. This allows positioning the flint 6, and therefor the break off point of the sparks, closer to the exit nozzle 15, such that despite the inclined course of the exit nozzle a sure ignition is guaranteed.

I claim:

1. A gas lighter for emitting a flame angled away from an ignition device thereof, said ligher comprising:

a housing having a gas tank;

a burner tube in said housing centered on an upright axis and communicating with said gas tank, said burner tube being formed at the upper end thereof with a flat collar having an upper annular surface lying transverse to said axis and a lower annular surface parallel to said upper annular surface;

a flat annular seal provided on said upper surface of said collar; and a stamped burner cap provided at the upper end of said burner tube and enclosing said seal, said cap having an upwardly converging conical portion centered on said axis and surrounded by a flat base portion lying parallel to said collar and bearing on an upper surface of said seal, said base portion having a downwardly extending skirt lying parallel to said axis and surrounding said collar, said skirt being formed with inwardly bent shoulders engaging beneath the lower surface of said collar, said conical portion of said cap being formed with a gas orifice at an angle to said axis.

* * * * *